US009963867B2

(12) United States Patent
Bush et al.

(10) Patent No.: US 9,963,867 B2
(45) **Date of Patent: *May 8, 2018**

(54) FENCE VALVE WITH INDICATOR

(71) Applicant: SDB IP Holdings, LLC, Oviedo, FL (US)

(72) Inventors: Shawn D. Bush, Winter Park, FL (US); Ryan W. Nottage, Marietta, GA (US)

(73) Assignee: SDB IP Holdings, LLC, Oviedo, FL (US)

( * ) Notice: Subject to any disclaimer, the term of this patent is extended or adjusted under 35 U.S.C. 154(b) by 52 days.

This patent is subject to a terminal disclaimer.

(21) Appl. No.: 15/164,049

(22) Filed: May 25, 2016

(65) Prior Publication Data

US 2016/0265211 A1 Sep. 15, 2016

Related U.S. Application Data

(63) Continuation of application No. 14/208,703, filed on Mar. 13, 2014, now Pat. No. 9,371,640.

(60) Provisional application No. 61/787,302, filed on Mar. 15, 2013.

(51) Int. Cl.

| | |
|---|---|
| ***E03C 1/26*** | (2006.01) |
| ***E03F 7/00*** | (2006.01) |
| ***E03D 11/00*** | (2006.01) |

(52) U.S. Cl.

CPC ..... *E03F 7/00* (2013.01); *E03D 11/00* (2013.01); *E03F 2201/40* (2013.01)

(58) Field of Classification Search

CPC ..... E03D 11/00
USPC ..... 4/286–295, 256.1
See application file for complete search history.

(56) References Cited

U.S. PATENT DOCUMENTS

| | | | | |
|---|---|---|---|---|
| 4,932,080 | A | 6/1990 | Pino | |
| 4,996,725 | A | 3/1991 | Pino | |
| 5,027,447 | A | 7/1991 | Pino | |
| 6,880,178 | B2 | 4/2005 | Pino | |
| 9,371,640 | B2 * | 6/2016 | Bush | E03D 11/00 |

* cited by examiner

*Primary Examiner* — Lori Baker
(74) *Attorney, Agent, or Firm* — The Webb Law Firm

(57) ABSTRACT

A fence valve to catch material introduced into a pipe includes a housing defining a chamber and a catch plate disposed within the chamber that is movable with respect to the housing. The catch plate includes at least one magnetic region. The valve further includes a magnetic body in communication with at least a portion of the chamber, an indicator in communication with the catch plate, and a cable having a first end secured to the catch plate and a second end secured to a hook. The catch plate is transitionable from a first position in which the catch plate is disposed at a first location within the chamber, to a second position in which the catch plate is displaced from the first location. The catch plate is detachably held in the first position by interaction between the at least one magnetic region and the magnetic body.

24 Claims, 5 Drawing Sheets

FENCE VALVE WITH INDICATOR

CROSS-REFERENCE TO RELATED APPLICATION

The present application is a continuation application of U.S. patent application Ser. No. 14/208,703, entitled "Fence Valve with Indicator" filed Mar. 13, 2014, which claims priority to U.S. Provisional Patent Application No. 61/787,302, entitled "Fence Valve with Indicator" filed Mar. 15, 2013, the entire disclosures of each of which are hereby incorporated by reference.

BACKGROUND OF THE INVENTION

Field of the Invention

The present invention relates to a fence valve for catching undesirable materials in a drain or sewer pipe. More specifically, the invention is directed to a fence valve having an indicator with adjustable sensitivity for alerting the user when such undesirable materials have been caught by the fence valve.

Description of Related Art

Fence valves are utilized in drain and sewer pipes to capture undesirable materials that tend to clog the pipes. Example prior fence valves have been described in U.S. Pat. Nos. 4,932,080, 4,996,725, 5,027,447, and 6,880,178.

A fence valve having an indicator for alerting the user when undesirable materials have been captured is described in U.S. Pat. No. 6,880,178. The described fence valve has an indicator that is located at the top of a tubular member that extends through the housing of the fence valve. At the bottom of the tubular member is a hook that extends out of the housing of the fence valve and into a drain or sewer pipe to catch the undesirable materials. Disposed within the fence valve between the indicator and a spacer and surrounding the tubular member is a kinetic energy store in the form of a spring. The housing in the area of the indicator and the spring is transparent. When the hook catches undesirable material, the weight of the material places a downward force on the tubular member which causes the indicator to move in a downward direction within the transparent housing and compress the spring. By looking through the housing and visually observing the position of the indicator and the compression of the spring, a user can determine when undesirable material has been captured by the hook of the fence valve.

A significant drawback to prior fence valves, including the valve described in U.S. Pat. No. 6,880,178 is that the sensitivity of the fence valve cannot be adjusted and is dependent on the mechanical resistance provided by the spring.

SUMMARY OF THE INVENTION

In certain situations, it is advantageous to provide a fence valve which allows adjustment of the sensitivity of the indicator. For example, a fence valve of the present invention may allow for adjustment of the sensitivity such that an indication that undesirable material has been captured is not provided until a certain amount or type of material has been collected or to avoid nuisance indications.

In accordance with an embodiment of the present invention, a valve apparatus includes a housing having a top and a bottom and defining a chamber extending between the top and the bottom. The valve also includes a catch plate disposed within the chamber that is movable with respect to the housing, with the catch plate including at least one magnetic region. The valve also includes a magnetic body in communication with at least a portion of the chamber, an indicator in communication with the catch plate, and a cable having a first end secured to the catch plate and a second end secured to a hook. The catch plate is transitionable from a first position in which the catch plate is disposed at a first position within the chamber, to a second position in which the catch plate is displaced from the first position. The catch plate is configured to be detachably held in the first position via an interaction between the magnetic region and the magnetic body.

The first position of the catch plate may be substantially adjacent the top of the housing and the second position may be axially displaced from the top of the housing. Optionally, the first position may be defined at an upper end of the chamber and the second position may be defined at a lower end of the chamber.

The valve may also include a cap positioned adjacent the top of the housing and enclosing at least a portion of the chamber. In certain configurations, at least a portion of the magnetic body is engaged with the cap. The position of the magnetic body may be adjustable to alter a distance between the magnetic body and the magnetic region when the catch plate is detachably held in the first position.

In other configurations, the valve also includes a cap enclosing at least a portion of the chamber and the indicator includes a shaft extending perpendicularly from the catch plate and extending through an opening in the cap. In certain embodiments, the magnetic region is ring-shaped and at least partially surrounds the shaft. In other embodiments, the magnetic region is co-formed with the catch plate. In still other embodiments, the magnetic region includes at least one magnet attached to the catch plate. The valve may also include a sensor adapted to interact with the magnetic region. In other configurations, the hook may be magnetic.

Upon transition of the catch plate from the first position to the second position, the indicator may be displaced from a first indicator position to a second indicator position. In still other configurations, the magnetic body may be positioned adjacent the top of the housing.

In accordance with another embodiment of the present invention, a valve apparatus includes a housing having a top and a bottom and defining a chamber extending between the top and the bottom. The valve further includes a catch plate disposed within the chamber and movable with respect to the housing, with the catch plate including at least one magnetic region. The valve further includes a magnetic body in communication with at least a portion of the chamber, a cap enclosing at least a portion of the chamber, wherein the position of the magnetic body is adjustable with respect to the cap such that a distance between the magnetic body and the magnetic region may be changed. The valve also includes a cable having a first end and a second end, the first end of the cable secured to the catch plate and the second end of the cable secured to a hook. The catch plate is transitionable from a first position in which the catch plate is disposed at a first position within the chamber, to a second position in which the catch plate is displaced from the first position, and the catch plate is configured to be detachably held in the first position via an interaction between the magnetic region and the magnetic body.

In certain configurations, the first position is substantially adjacent the top of the housing and the second position is axially displaced from the top of the housing. In one embodiment, the magnetic region is co-formed with the catch plate. In another embodiment, the magnetic region includes at least one magnet attached to the catch plate. Optionally, the valve includes at least one indicator for indicating when the catch plate is in at least one of the first position and the second position.

In accordance with another embodiment of the present invention a valve apparatus includes a housing having a top and a bottom and defining a chamber extending between the top and the bottom. The valve also includes a catch plate disposed within the chamber that is movable with respect to the housing, the catch plate is transitionable from a first position in which the catch plate is disposed at a first position within the chamber, to a second position in which the catch plate is displaced from the first position, the catch plate being configured to be detachably held in the first position. The valve also includes a sensor configured to detect when the catch plate is in at least one of the first position and the second position, and a cable having a first end and a second end, the first end of the cable secured to the catch plate and the second end of the cable secured to a hook.

The valve assembly may also include a magnetic body in communication with at least a portion of the chamber, wherein the catch plate includes a magnetic region. The catch plate may be detachably held in the first position by the magnetic region interacting with the magnetic body. The magnetic region may be at least one of a region co-formed with the catch plate and a magnet attached to the catch plate.

DETAILED DESCRIPTION OF THE INVENTION

Figure 1:
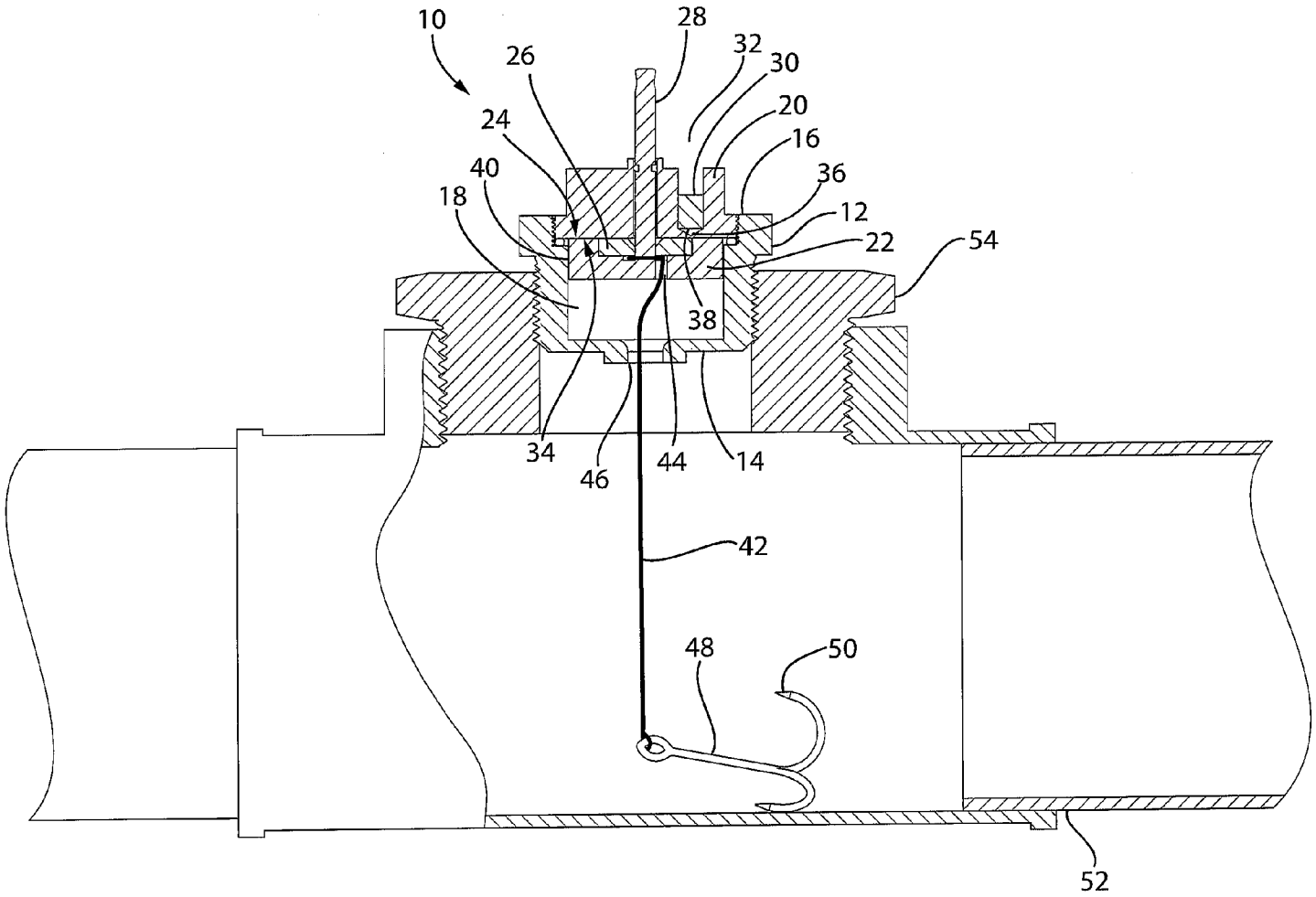
FIG. 1 is a schematic cross-sectional view of a fence valve in accordance with the present invention in an initial position prior to catching any material.
Figure 2:
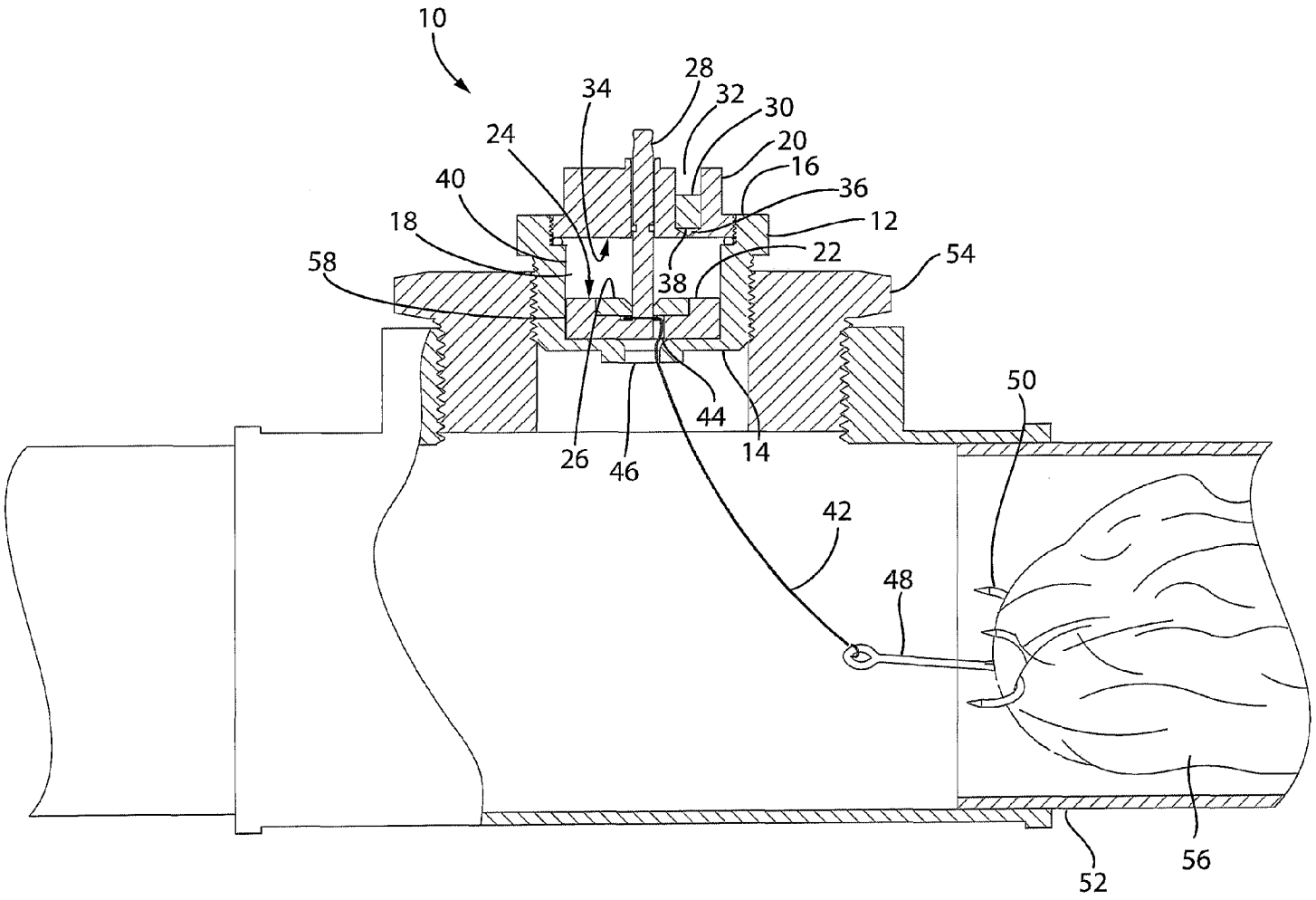
FIG. 2 is a schematic cross-sectional view of the fence valve of FIG. 1 in an engaged position after catching material.

As shown in FIGS. 1 and 2, one embodiment of a fence valve 10 comprises a housing 12. A bottom 14 of the housing 12 is closed and a top 16 of the housing 12 is substantially open. A chamber 18 extends from the top 16 of the housing 12 to the bottom 14 of the housing 12. The housing 12 may be generally cylindrical in shape as shown in FIGS. 1 and 2, although other suitable shapes may be utilized for the housing 12.

The top 16 of the housing 12 is covered by a cap 20 to enclose the chamber 18. For reasons that will become apparent, the cap 20 is made from a non-magnetic material. In order to make the chamber 18 water tight, a rubber gasket may be placed between the cap 20 and the housing 12. The cap 20 may be affixed to the chamber 18 by any suitable method including, but not limited to, a threaded mating engagement between the cap 20 and the housing 12 or a snap-fit engagement between the cap 20 and the housing 12.

A catch plate 22 is disposed within the chamber 18. The catch plate 22 may include at least one magnetic region co-formed or separately formed and subsequently assembled with the catch plate 22. In one configuration, at least one magnet may be attached to a top surface 24 of the catch plate 22. Also, attached to the catch plate 22 is an indicator 28. In the embodiment shown in FIGS. 1 and 2, the indicator 28 is a shaft attached perpendicularly to the catch plate 22 that extends through the cap 20. However, the indicator 28 may take a variety of forms as long as it is capable of communicating the position of the catch plate 22 within the chamber 18.

A magnet 26 may include a singular magnetic body or may include a plurality of spaced magnets and may have any suitable size and shape. The magnet 26 in the embodiment shown in FIGS. 1 and 2 is substantially ring-shaped and surrounds at least a portion of the indicator 28. In one embodiment, the magnet 26 may fully surround the indicator 28 in the form of a ring surrounding a shaft.

A magnetic body 30 may be disposed with the cap 20, such as at least partially within an opening 32 in the cap 20 and positioned to interact with the magnet 26 affixed to a portion of the catch plate 22, such as the top surface 24 of the catch plate 22. In the embodiment shown in FIGS. 1 and 2, the opening 32 does not extend through a bottom surface 34 of the cap 20. A portion 36 of the cap 20 covering a bottom 38 of the magnetic body 30 must be of a thickness and density such that it allows the magnet 26 and the magnetic body 30 to interact to detachably hold the catch plate 22 at a top 40 of the chamber 18. Alternatively, the opening 32 could extend completely through the bottom surface 34 of the cap 20. The magnetic body 30 may be made of any suitable magnetic material including, but not limited to, zinc-coated steel. The magnetic body 30 may be of any size or shape as long as it interacts with the magnet 26 to detachably hold the catch plate 22 at the top 40 of the chamber 18.

A first end of a cable 42 is affixed to the catch plate 22. The cable 42 may be affixed using any suitable method including, but not limited to, tying, bolting, welding, and riveting. In the embodiment shown in FIGS. 1 and 2, the cable 42 extends through a hole 44 defined in the catch plate 22 and is securely tied to the indicator 28. The cable 42 also extends through an opening 46 in the bottom 14 of the housing 12. The cable 42 may be made of any suitable material including, but not limited to, nylon coated steel.

A hook 48 is attached to the second end of the cable 42. The hook 48 may be attached to the cable 42 using any suitable means including tying, bolting, welding, and crimping. The hook 48 may have a single prong 50 or a plurality of prongs 50 adapted to restrain unwanted debris present in a sewer pipe 52 into which the hook 48 is deployed. Alternatively, the hook 48 may include a porous member for restraining debris within a pore structure or a net member. The hook 48 may be made of any suitable material including, but not limited to, steel and may be magnetized so that it will attract magnetic articles passing through the drain or sewer pipe 52. The length of the cable 42 is adjusted such that when the fence valve 10 is attached to a drain or sewer pipe 52, the hook 48 will be positioned in the flow of the fluid passing through the pipe 52.

The fence valve 10 is provided with an arrangement for attaching it to a drain or sewer pipe 52. Such arrangements include, but are not limited to, a threaded bushing 54 attached to the housing 12 of the fence valve 10 and to a tee in the pipe 52, a pipe section comprising a radially extending tee attached to the housing 12 and a pipe section placed in line with the sewer pipe 52, or both, as shown in the embodiment in FIGS. 1 and 2.

As shown in FIG. 1, when the fence valve 10 has not captured any material from the flow through the pipe 52, the catch plate 22 is detachably held in a position at the top 40 of the chamber 18 by the interaction of the magnet 26 and the magnetic body 30. In this position, the indicator 28 extends through the cap 20. The hook 48 is positioned within the flow through the pipe 52.

As shown in FIG. 2, when the hook 48 has captured some material 56 from the flow through the pipe 52, the combination of the weight of the material 56 and the flow through the pipe 52 will exert force on the cable 42. The cable 42 in turn will place a downward force on the catch plate 22. When the downward force on the catch plate 22 exceeds the upward force on the catch plate 22 created by the interaction of the magnet 26 and the magnetic body 30, the catch plate 22 will be pulled by the cable 42 to a bottom 58 of the chamber 18. As a result, the indicator 28 will also be moved in a downward direction such that a significantly shorter portion of its length extends through the cap 20. Thus, by looking at the position of the indicator 28, the user can determine whether the fence valve 10 has captured any material 56. Once debris has been cleared from the hook 48, the indicator 28 may be reset and returned to the initial position so as to alert a user of a subsequent capture of additional debris. This resetting of the indicator 28 may also be appropriate in the instance of a false trigger, thus the fence valve of the present invention is intended for multiple uses and re-uses.

Figure 3:
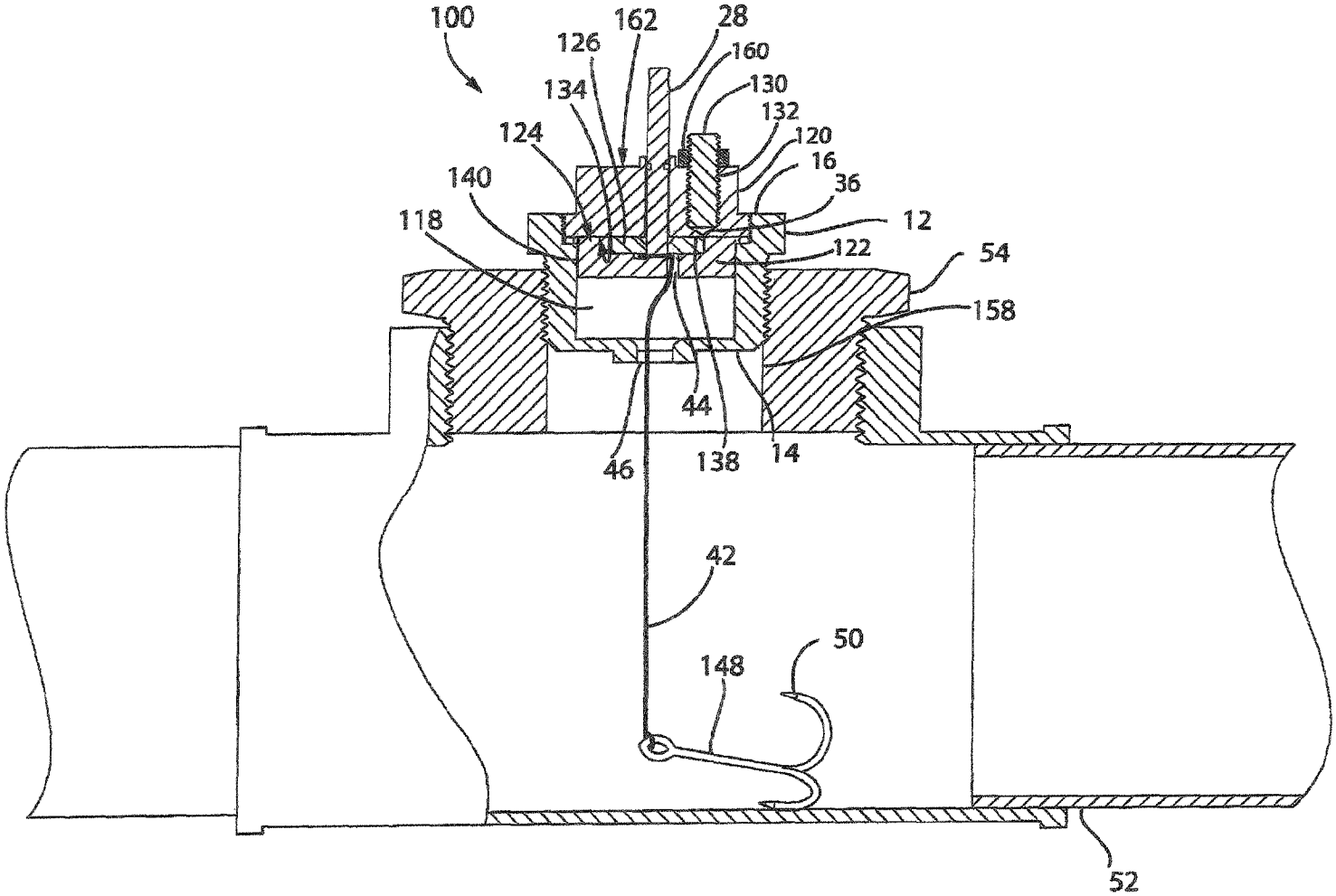
FIG. 3 is a schematic cross-sectional view of a fence valve in accordance with the present invention in an initial position prior to catching any material.

In another embodiment shown in FIG. 3, a fence valve 100 includes a magnetic body 130 vertically adjustable with respect to a bottom 134 of a cap 120 such that the distance between the magnetic body 130 and a magnet 126 may be changed. Any suitable mechanism may be used to provide for adjustment of the magnetic body 130. In the embodiment of FIG. 3, the magnetic body 130 is a magnetic rod that is vertically adjustable within an opening 132 to allow a bottom 138 of the magnetic body 130 to be positioned at an adjustable distance from the bottom 134 of the cap 120. The magnetic body 130 and the opening 132 are threaded to allow for adjustment of the magnetic body 130. Once the magnetic body 130 is in the desired position, a nut 160 may be placed on the magnetic body 130 and tightened until it sits against a top surface 162 of the cap 120. Other forms of providing adjustment for the magnetic body 130 include, but are not limited to, a plurality of holes positioned at various distances along the axis of the magnetic body 130 and a cotter pin to hold the magnetic body 130 with respect to the cap 120 or a detent provided in the cap 120 that interacts with grooves spaced at various distances along the axis of the magnetic body 130.

The sensitivity of the fence valve 100 to material captured on a hook 148 may be adjusted using the magnetic body 130. When the magnetic body 130 is adjusted within the opening 132 in the cap 120 such that the bottom 138 of the magnetic body 130 is close to the bottom 134 of the cap 120, the upward force on a catch plate 122 from the interaction of the magnet 126 and the magnetic body 130 when the catch plate 122 is detachably held at a top 140 of a chamber 118 will be at a maximum. As the bottom 138 of the magnetic body 130 is adjusted vertically within the opening 132 in the cap 120 to be displaced farther from the bottom 134 of the cap 120 and, thus, farther from the magnet 126, the upward force from the interaction of the magnet 126 and the magnetic body 130 on the catch plate 122 when the catch plate 122 is detachably held at the top 140 of the chamber 118 is decreased. Thus, by adjusting the position of the magnetic body 130 within the opening 132 in the cap 120, the user determines the amount of corresponding downward force that must be placed on the catch plate 122 to move the catch plate 122 to a bottom 158 of the chamber 118. Since this downward force is a function of the amount and type of material that is captured by the hook 148, the user has the ability to set the sensitivity of the fence valve 110 indication based on the type and amount of captured material. In this manner, the user can determine the conditions under which the fence valve 110 will indicate when it has captured the critical type and/or amount of material.

Figure 4:
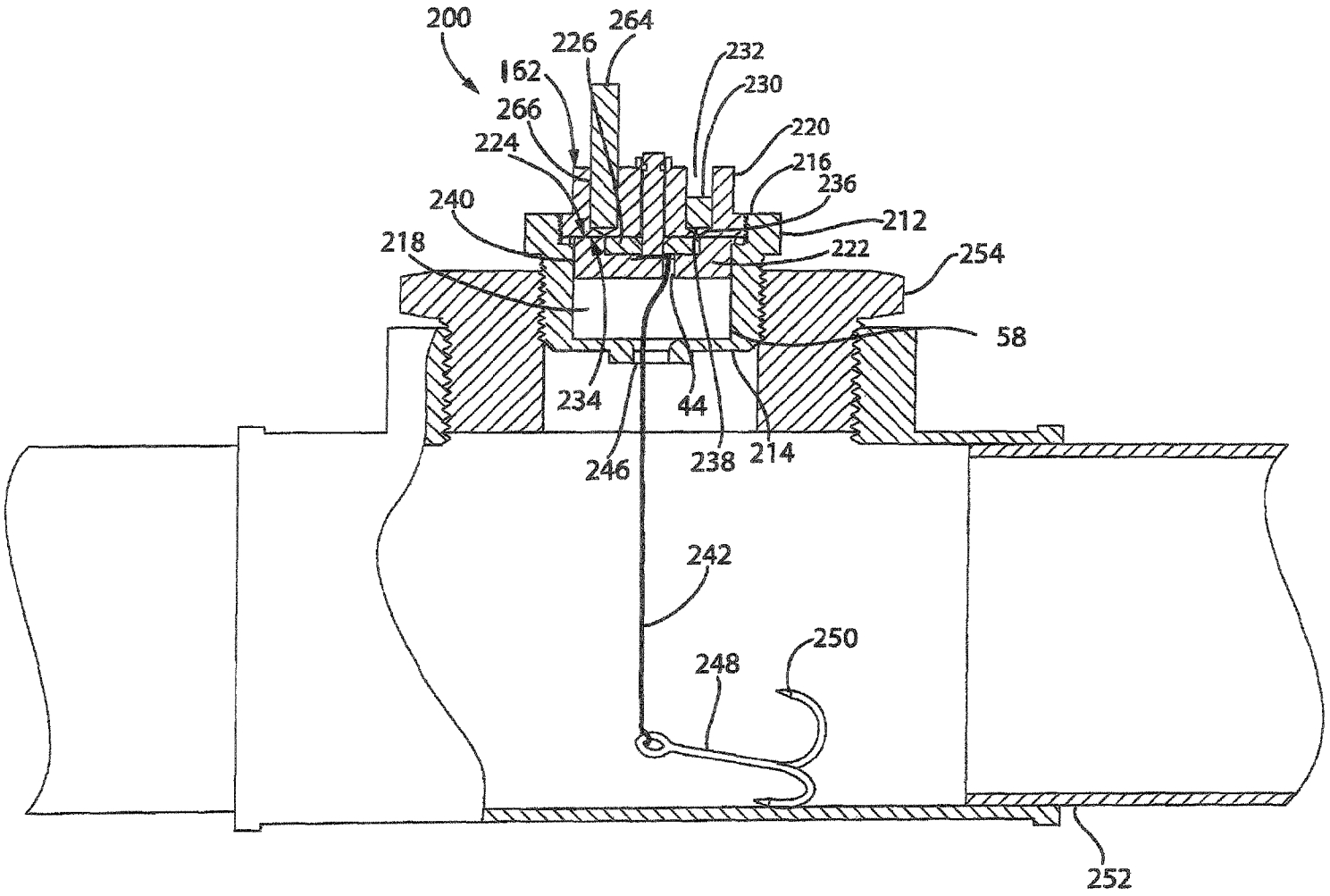
FIG. 4 is a schematic cross-sectional view of a fence valve in accordance with the present invention in an initial position prior to catching any material.

In an alternative embodiment, shown in FIG. 4, a fence valve 200 includes a sensor 264 in place of an indicator attached to a catch plate 222. The fence valve 200 includes a housing 212 having a bottom 214 that is closed and a top 216 that is open. A chamber 218 extends from the top 216 of the housing 212 to the bottom 214 of the housing 212. The housing 212 may be generally cylindrical in shape as shown in FIG. 4.

The top 216 of the housing 212 is covered by a cap 220 to enclose the chamber 218. For reasons that will become apparent, the cap 220 is made from a non-magnetic material. In order to make the chamber 218 water tight, a rubber gasket may be placed between the cap 220 and the housing 212. The cap 220 may be affixed to the chamber 218 by any suitable method including, but not limited to, a threaded mating engagement between the cap 220 and the housing 212 or a snap-fit engagement between the cap 220 and the housing 212.

The catch plate 222 is disposed within the chamber 218. Attached to a top surface 224 of the catch plate 222 is a least one magnet 226. While the magnetic region 226, including a magnet or plurality of magnets 226, may have any suitable size and shape, the magnetic region 226 in the embodiment show in FIG. 4 is ring-shaped.

A detaching arrangement is provided for holding the catch plate 222 at a top 240 of the chamber 218 near the cap 220. The detaching arrangement may be any suitable engagement between the catch plate 222 and the cap 220 and/or the housing 212 to hold the catch plate 222 near the cap 220 until sufficient downward force is placed on the catch plate 222 to move it in a downward direction within the chamber 218. Such arrangements include, but are not limited to, a latch on the cap 220 or housing 212 engaged with a portion of the catch plate 222 and a spring connecting the catch plate 222 to the cap 220.

In the embodiment shown in FIG. 4, the detaching arrangement for holding the catch plate 222 at the top 240 of the chamber 218 is a magnetic body 230 disposed within an opening 232 in the cap 220 and positioned to interact with the magnet 226 affixed to the top surface 224 of the catch plate 222. The opening 232 does not extend through a bottom surface 234 of the cap 220. A portion 236 of the cap 220 covering a bottom 238 of the magnetic body 230 must be of a thickness and density such that it allows the magnet 226 and the magnetic body 230 to interact to hold the catch plate 222 at a top 240 of the chamber 218. The magnetic body 230 may be made of any suitable magnetic material including, but not limited to, zinc-coated steel. The magnetic body 230 may be of any size or shape as long as it interacts with the magnet 226 to detachably hold the catch plate 222 at the top 240 of the chamber 218.

A sensor 264 is provided within an opening 266 in the cap 220. The sensor 264 may be placed such that it is in proximity to the magnet 226 when the catch plate 222 is detachably held near the top 240 of the chamber 218. The sensor 264 may be of a type that detects the presence of a magnetic field. Such a sensor 264 may be a reed sensor.

One end of a cable 242 is affixed to the catch plate 222. The cable 242 may be affixed using a suitable method including, but not limited to, tying, bolting, welding, and riveting. The cable 242 extends through an opening 246 in the bottom 214 of the housing 212. The cable 242 may be made of any suitable material including, but not limited to, nylon coated steel.

A hook 248 is attached to the other end of the cable 242. The hook 248 may be attached to the cable 242 using any suitable means including tying, bolting, welding, and crimping. The hook 248 may have a single prong 250 or a plurality of prongs 250. The hook 248 may be made of any suitable material including, but not limited to, steel and may be magnetized so that it will attract magnetic articles passing through a drain or sewer pipe 252. The length of the cable 242 is adjusted such that when the fence valve 210 is attached to the drain or sewer pipe 252, the hook 248 will be positioned in the flow of the fluid passing through the pipe 252.

The fence valve 210 is provided with an arrangement for attaching it to a drain or sewer pipe 252. Such arrangements include, but are not limited to, a threaded bushing 254 attached to the housing 212 of the fence valve 210 and to a tee in the pipe 252, a pipe section comprising a radially extending tee attached to the housing 212, and a pipe section placed in line with the sewer pipe 252, or both, as shown in the embodiment in FIG. 4.

When the hook 248 has captured some material from the flow through the pipe 252, the combination of the weight and type of the material with the flow through the pipe 252 will exert a force on the cable 242. The cable 242 in turn will place a downward force on the catch plate 222. When the downward force on the catch plate 222 exceeds the upward force on the catch plate 222 created by the detachable arrangement provided for holding the catch plate 222 near the top 240 of the chamber 218. The catch plate 222 will move in a downward direction within the chamber 218. This will move the magnet 226 farther away from the sensor 264. When the magnet 226 has moved a sufficient distance from the sensor 264 that the sensor 264 detects a change in the magnetic field, the sensor 264 will indicate to the user that the hook 248 has captured some material. The indication may be provided to the user in any suitable fashion including, but not limited to, a light or a sound from the sensor 264 itself. Alternatively, the sensor 264 may be connected via wired or wireless communication to a controller for providing the indication.

If a sensor 264 with adjustable sensitivity is provided, the sensitivity of the sensor 264 to the distance that the magnet 226 must be moved from the sensor 264 to provide an indication to the user may be adjusted to set the sensitivity of the fence valve 210 indication based on the type and amount of captured material. In this manner, the user can determine the conditions under which the fence valve 210 will indicate when it has captured the critical type and/or amount of material.

Alternatively, the sensor 264 may be adjustable with respect to the bottom 234 of the cap 220 such that the distance between the sensor 264 and the magnet 226 may be changed. Any suitable mechanism may be used to provide for adjustment of the position of the sensor 264. This will change the distance that the magnet 226 must be moved from the sensor 264 to provide an indication to the user and allow the user to adjust the sensitivity of the fence valve 210 indication based on the type and amount of captured material.

Figure 5:
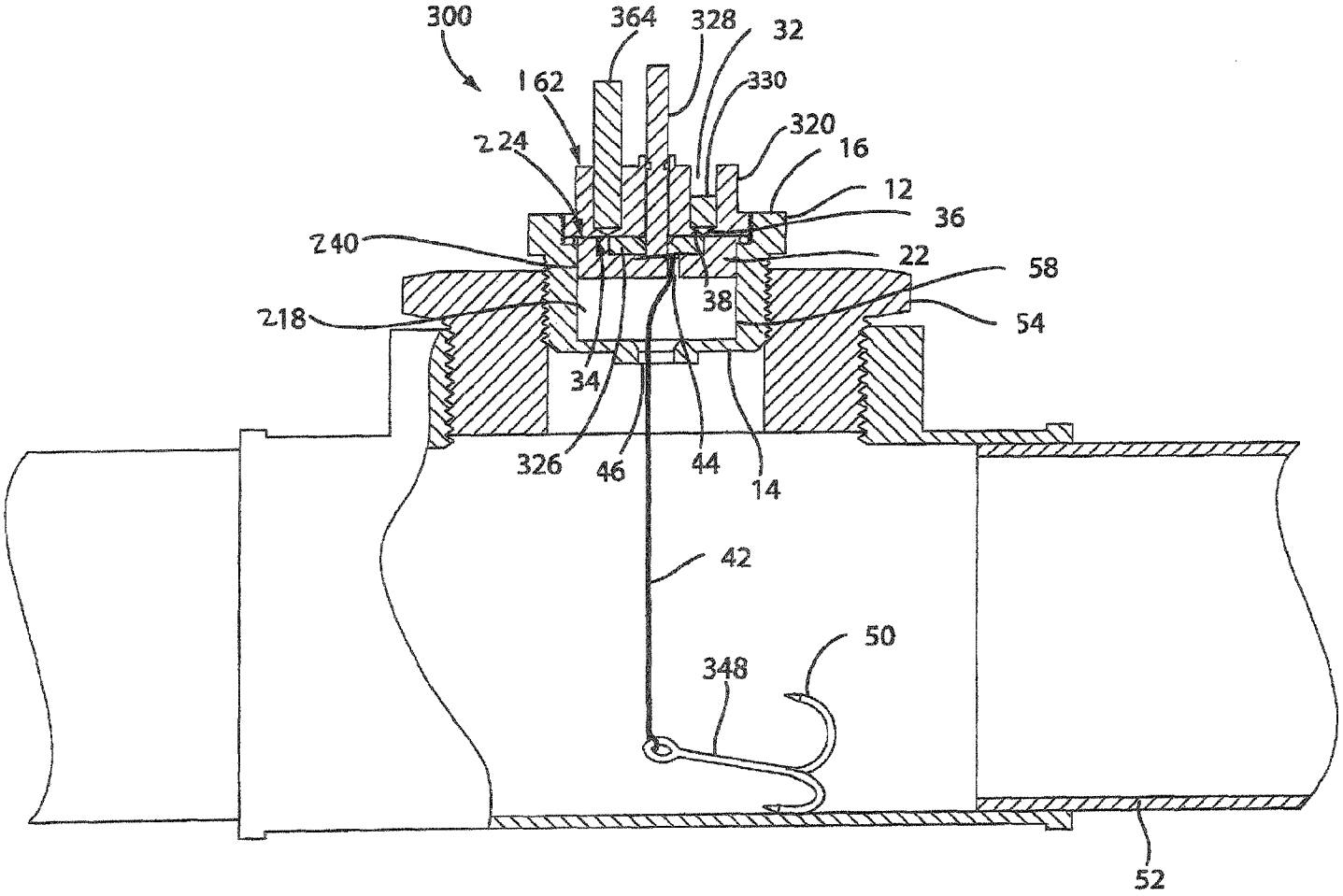
FIG. 5 is a schematic cross-sectional view of a fence valve in accordance with the present invention in an initial position prior to catching any material.

In another embodiment 300, shown in FIG. 5, the fence valve 10 of FIGS. 1 and 2 may also include a sensor 364 in addition to or as a replacement for an indicator 328.

A magnet 326 may be a single ring magnet that interacts with both the sensor 364 and a magnetic body 330 or there may be two magnets 326, one which interacts with the sensor 364 and one which interacts with the magnetic body 330. The indicator 328 may optionally be provided as it gives a secondary indication that a hook 348 has captured material if the sensor 364 fails and provides a convenient means for resetting a fence valve 310 if a false positive indication occurs.

While this embodiment of the fence valve 310 has not been described as having an adjustable magnetic body 330 and/or sensor 364 for allowing the sensitivity of the fence valve 310 to be adjusted, it should be understood that such an adjustable magnetic body 330 or sensor 364 could be included.

While several embodiments of a fence valve were described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this specification. For example, it is to be understood that the present invention contemplates that, to the extent possible, one or more features of any embodiment can be combined with one or more features of any other embodiment.

What is claimed is:

1. A valve apparatus, comprising:

a housing having a top and a bottom and defining a chamber extending between the top and the bottom;

a catch plate disposed within the chamber and movable with respect to the housing;

a cable having a first end and a second end, the first end of the cable secured to the catch plate and the second end of the cable secured to a hook, wherein the catch plate is transitionable from a first position in which the catch plate is disposed at a first location within the chamber, to a second position in which the catch plate is displaced from the first location.

2. The valve apparatus of claim 1, further comprising:

a magnetic body in communication with at least a portion of the chamber;

an indicator in communication with the catch plate, wherein the catch plate comprises at least on magnetic region, and wherein the catch plate is configured to be detachably held in the first position via an interaction between the at least one magnetic region and the magnetic body.

3. The valve apparatus of claim 1 wherein the first location is substantially adjacent the top of the housing and the second position is axially displaced from the top of the housing.

4. The valve apparatus of claim 1, wherein the first location is defined at an upper end of the chamber and the second position is defined at a lower end of the chamber.

5. The valve apparatus of claim 1, further comprising a cap positioned adjacent the top of the housing and enclosing at least a portion of the chamber.

6. The valve apparatus of claim 5, further comprising a cap positioned adjacent the top of the housing and enclosing at least a portion of the chamber, wherein at least a portion of the magnetic body is engaged with the cap.

7. The valve apparatus of claim 6, wherein the position of the magnetic body is adjustable to alter a distance between the magnetic body and the at least one magnetic region when the catch plate is detachably held in the first position.

8. The valve apparatus of claim 2, further comprising a cap enclosing at least a portion of the chamber and wherein the indicator comprises a shaft extending perpendicularly from the catch plate and extending through an opening in the cap.

9. The valve apparatus of claim 8, wherein the at least one magnetic region is ring-shaped and at least partially surrounds the shaft.

10. The valve apparatus of claim 2, wherein the at least one magnetic region is co-formed with the catch plate.

11. The valve apparatus of claim 2, wherein the at least one magnetic region comprises at least one magnet attached to the catch plate.

12. The valve apparatus of claim 1, further comprising a sensor adapted to interact with the catch plate.

13. The valve apparatus of claim 1, wherein the hook is magnetic.

14. The valve apparatus of claim 1, further comprising an indicator in communication with the catch plate, wherein upon transition of the catch plate from the first position to the second position, the indicator is displaced from a first indicator position to a second indicator position.

15. The valve apparatus of claim 2, wherein the magnetic body is positioned adjacent the top of the housing.

16. The valve apparatus of claim 1, further comprising:

the catch plate comprising at least one magnetic region;

a magnetic body in communication with at least a portion of the chamber; and a cap enclosing at least a portion of the chamber, wherein the position of the magnetic body is adjustable with respect to the cap such that a distance between the magnetic body and the at least one magnetic region may be changed, wherein the catch plate is configured to be detachably held in the first position via an interaction between the at least one magnetic region and the magnetic body.

17. The valve apparatus of claim 1, wherein the first location is substantially adjacent the top of the housing and the second position is axially displaced from the top of the housing.

18. The valve apparatus of claim 16, wherein the at least one magnetic region is co-formed with the catch plate.

19. The valve apparatus of claim 16, wherein the at least one magnetic region comprises at least one magnet attached to the catch plate.

20. The valve apparatus of claim 1, further comprising at least one indicator for indicating when the catch plate is in at least one of the first position and the second position.

21. The valve apparatus of claim 1, further comprising:

a sensor configured to detect when the catch plate is in at least one of the first position and the second position, wherein the catch plate configured to be detachably held in the first position.

22. The valve apparatus of claim 21, further comprising a magnetic body in communication with at least a portion of the chamber, and wherein the catch plate comprises a magnetic region.

23. The valve apparatus of claim 22, wherein the catch plate is detachably held in the first position by the magnetic region interacting with the magnetic body.

24. The valve apparatus of claim 22, wherein the magnetic region is at least one of a region co-formed with the catch plate and a magnet attached to the catch plate.

* * * * *